US005083799A

United States Patent [19]

Thill

[11] Patent Number: 5,083,799

[45] Date of Patent: Jan. 28, 1992

[54] LIGHTABLE WHISTLING DISC

[75] Inventor: Gerald D. Thill, Minneapolis, Minn.

[73] Assignee: Spearhead Industries, Inc., Bloomington, Minn.

[21] Appl. No.: 650,187

[22] Filed: Feb. 4, 1991

[51] Int. Cl.[5] ..... A63B 65/10

[52] U.S. Cl. ..... 273/424; 446/47

[58] Field of Search ..... 273/424, 425; 446/46, 446/47, 254, 265, 404, 397, 419

[56] References Cited

U.S. PATENT DOCUMENTS

| | | | |
|---|---|---|---|
| 522,268 | 7/1894 | Lumley | 446/254 |
| 4,031,655 | 6/1977 | Ponciano et al. | 446/47 |
| 4,086,723 | 5/1978 | Strawick | 446/47 |
| 4,135,325 | 1/1979 | Lehman | 446/46 |
| 4,552,542 | 11/1985 | Reysman | 446/254 |

*Primary Examiner*—Paul E. Shapiro
*Attorney, Agent, or Firm*—James R. Cwayna

[57] ABSTRACT

A toy in the form of a tossable disc capable of being illuminated and provided with elements to create an auditory sound as the unit is tossed and spun through the air. The unit includes a substantially flat, planar section and an inflatable ring therearound and attached thereto with a chemiluminescent light source positioned on the planar section and a plurality of whistle elements mounted on the inflated ring such that as the toy is tossed through the air the movement thereof will present an auditory sound and the chemiluminescent light source may be activated at the user's desire.

1 Claim, 2 Drawing Sheets

LIGHTABLE WHISTLING DISC

FIELD OF THE INVENTION

This invention relates generally to tossable toy discs and more particularly to such a toy disc having a planar section, an inflatable ring portion, a light source and auditory emission elements.

SHORT SUMMARY OF THE INVENTION

A tossable toy disc in the field of playthings which is normally tossed from person to person or may be used in various games in which such a tossable disc is utilized.

The disc is provided of a normally flat, circular, flexible section to permit folding for packaging or the like and includes a tubular member attached to the outer periphery of one side thereof which tubular member is inflatable and which will, upon inflation, provide a relatively rigid but soft and collapsible plaything. One advantage of the inflation construction is to provide a resulting generally soft toy which is definitely safer than those hard disc elements which are utilized in similar situations.

Arranged on the substantially planar section is a pocket or article receiving portion into which a chemiluminescent element removeably received. Obviously this chemiluminescent element provides light to the unit when the element is activated.

Spaced around what may be termed the upper side of the inflatable ring are a plurality of whistle retaining straps for retaining a plurality of spaced noise creating devices which provide sound when the unit is tossed and spins in the air. The devices in this case are hollow balls having holes through their skins.

BACKGROUND AND OBJECTS OF THE INVENTION

Applicant has searched what he believes the proper related art fields and has found no patents which can be stated to be of patentable or inventive comparison. As required, any art that is hereafter discovered will be revealed during the prosecution of this patent application. With regard to commercial art availability, again applicant has found no, what may be termed to be an inflatable, toss disc unit. The closest concept to the invention as disclosed is what is well known in the art as the FRISBEE. The term Frisbee is a registered Trademark but many similar flying discs of the same generic type are available. Applicant believes the trademark FRISBEE is owned by Wham-O Products.

The utilization of tossing discs such as the Frisbee is well known in the art and many games including Frisbee Golf have been developed to promote the useability and toy interest of the unit. It is also well known that Frisbees and similar discs do represent a certain element of danger and persons have been struck by these units resulting in injuries.

It is the applicant's concept to provide a toss toy which is, through the inflatability of the unit. relatively soft in comparison to a rigid object and therefore will not cause any physical injury when striking a person. The inflatability afforded in applicant's device will not transform the unit into a rigid object but allows deformation upon striking and also makes the unit easier to group.

In addition to the characteristic softness of the applicant's invention, two play consideration improvements are included thereon. The first of these is to increase the play value and particularly the time of useage for the unit due to the chemiluminescent light source provided on the unit. A chemiluminescent cartridge may be inserted into the unit to make the unit more visible at night. The only aspect of currently available discs to increase the visibility thereof is the use of neon coloring to heighten the light reflective characteristics of such a disc.

The second aspect of the applicant's device increasing the play value and which could be termed a safety ingredient is the utilization of audible devices on the unit to create a noise when the same is tossed and spun through the air. It is within the scope of the invention and it is conceivable that proper noise emitting units would be useable by the blind in the same manner baseballs are currently utilized by the blind with the baseballs having a noise emitting transmitter incorporated therein.

It is therefore an object of the applicant's invention to provide a toy disc designed for tossing between persons which includes a substantially planar portion and an inflatable ring surrounding such portion to provide a compressible or deformable tossing object.

It is a further object of the applicant's invention to provide a plaything in the form of a tossable disc which incorporates a chemiluminescent cartridge receiving area for placement of a chemiluminescent, light emitting source therein.

It is a further object of the applicant's invention to provide a toy disc for tossing by persons which includes a noise emitting element to create a sound as the same is tossed in the air.

These and other objects and advantages of the applicant's invention will more fully appear from a consideration of the accompanying drawings and disclosure.

SHORT DESCRIPTION OF THE DRAWINGS

DESCRIPTION OF A PREFERRED FORM OF THE INVENTION

Figure 1:
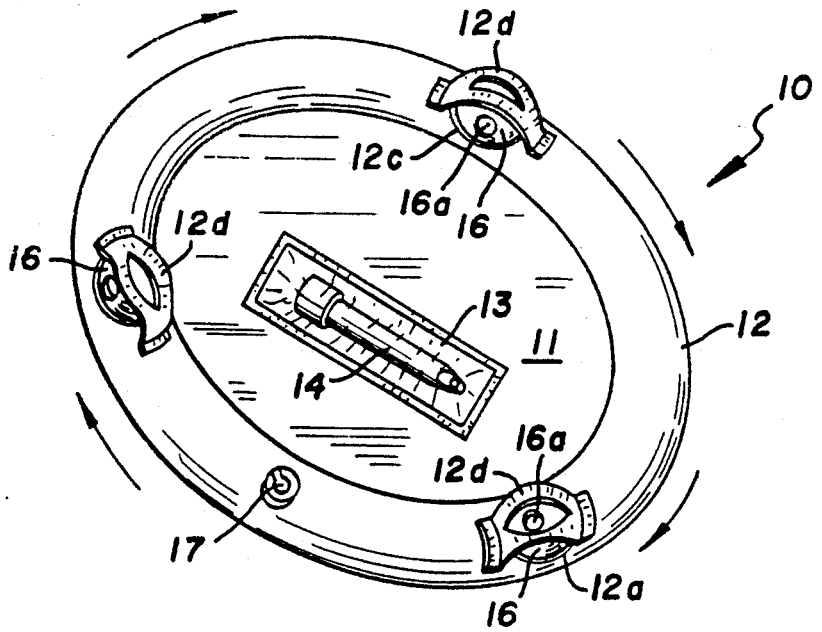
FIG. 1 is a perspective view of a tossable disc embodying the concepts of the applicant's invention.
Figure 2:
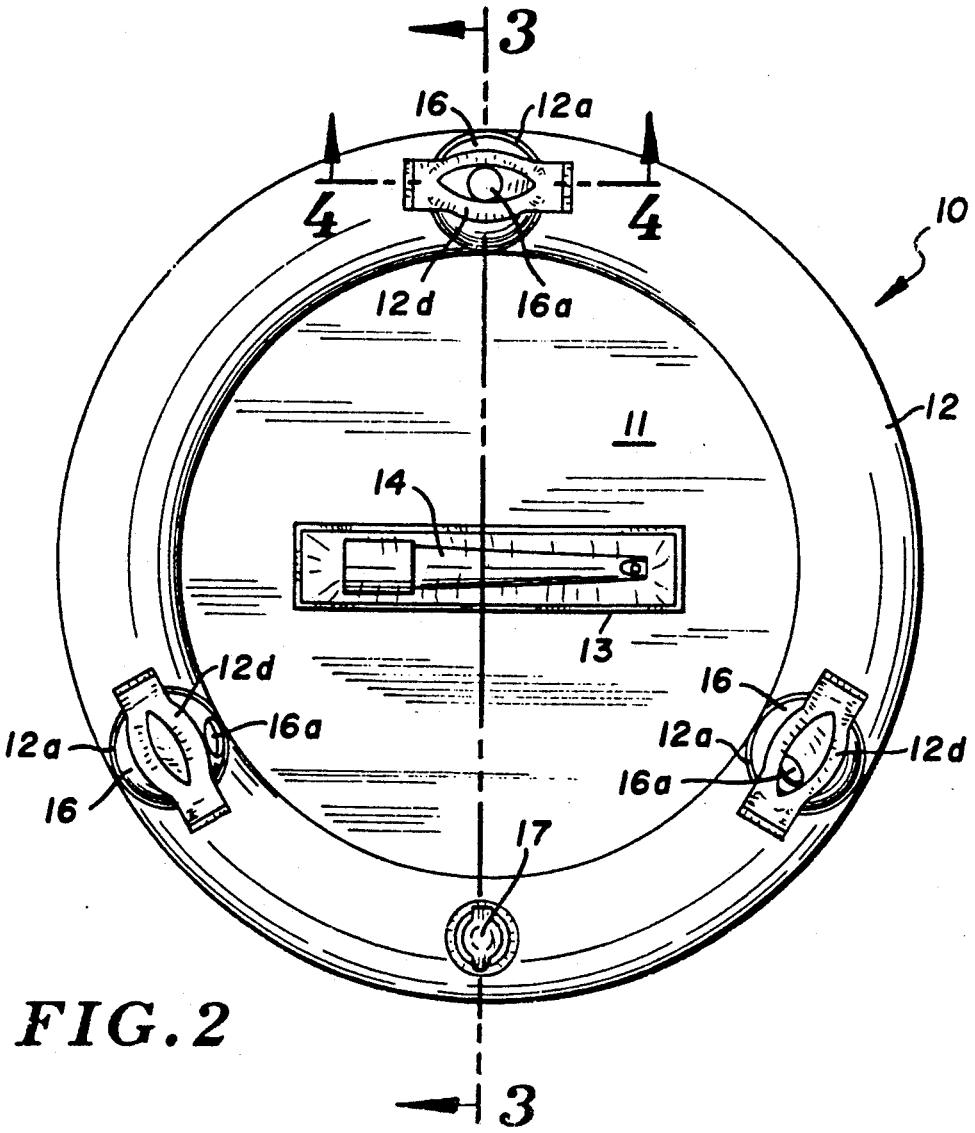
FIG. 2 is a top plan view thereof.
Figure 3:
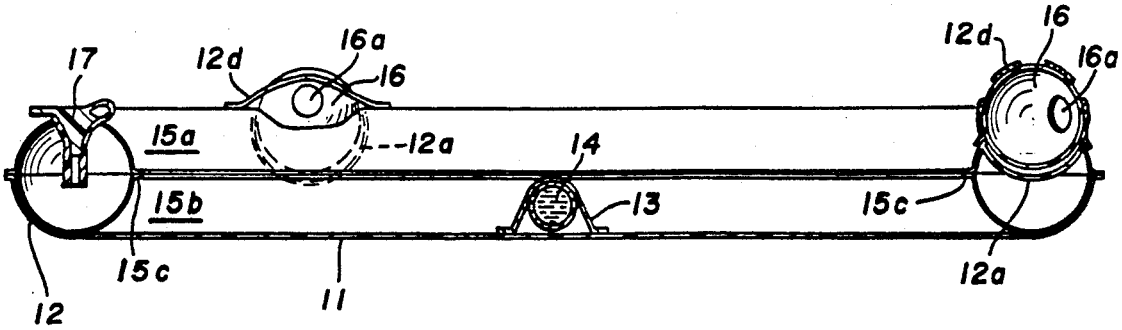
FIG. 3 is a section taken substantially along line 3—3 of FIG. 2.
Figure 4:
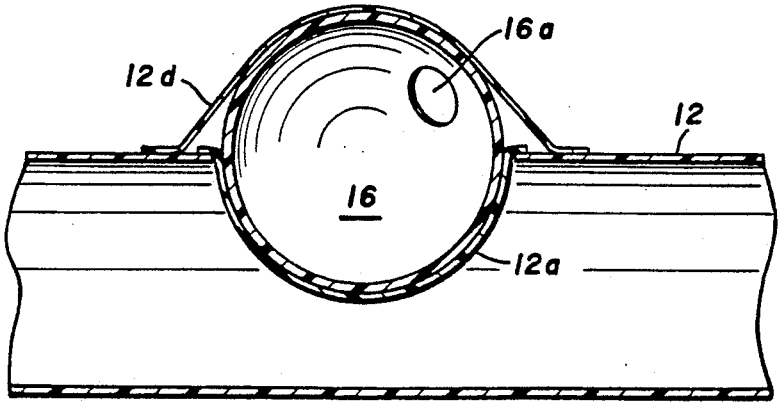
FIG. 4 is a transverse section taken substantially along line 4—4 of FIG. 2.

In accordance with the accompanying drawings the applicant's lightable and sound emitting tossable disc is generally designated 10. As illustrated, the unit includes two basic element which are a platform 11 and an inflatable ring 12.

Both of these sections 11 and 12 are formed of flexible resilient materials such as plastic or rubber such that the unit may be compactly folded for packaging and shipping but which will, upon inflation of the ring 12 provide a relatively substantially rigid although deformable unit for tossing between persons or, as stated, at targets when the device is used in a game.

The platform section 11 is, in the form shown, generally circular in shape to conform to the inflated ring 12 and the two elements are joined through heat sealing or one of many other known joining techniques.

Arranged generally centrally of the platform 11, is a packet receiving housing 13, again attached to platform 11 into which a chemiluminescent unit 14 is insertable and removeable.

Such chemiluminescent units 14 are well known in the art and consist of two chemicals contained in a single housing with one of the chemicals being housed in a rupturable vial which upon breakage unites with the second chemical to create a light source. Obviously means for access and egress must be provided into the housing 13 for insertion and removal of the vial 14.

The ring structure 12 is basically circular in shape but for other effects could provide an oval or other desired shape just for differentiation of product line. The ring 12, as shown, consists of two halves 15*a*–15*b* which are joined as at 15*c* to form a continuous ring. Obviously many methods may be utilized to provide such a ring without departing from the scope of the invention.

An inflation valve generally designated 17 is provided at a selected portion of the ring 12 and such valve members are commonly known in the art and no further description is deemed necessary at this point.

Arranged about the periphery of the ring 12 and on what may be termed one side thereof, are a plurality of ball receiving pockets 12*a*, 12*b*, 12*c* securely and sealingly attached to the outer surface of the ring material 12 to receive a hollow ball member 16 therein. Each of the balls 16 are identical and include at least one opening 16*a* through the periphery thereof which will effect an air impeding area when the unit is tossed and spun through the air. This hollow ball, wind tunnel structure effects a whistle as the unit 10 is tossed through the air. Although the applicant has shown a plurality of such balls arranged around the ring 12 it should be obvious that the number of balls may vary from one upwardly.

Overlying each ball pocket 12*a* is a retaining strap 12*d* for effectively holding the ball 16 within the pocket.

Obviously the unit may be used with either or both of the additive elements, the light or the "whistles", dependent upon the user's desires.

The inflatability of the unit allows a certain amount of rigidity for tossing the same while the air filled qualities of the unit allow for collapsing should the unit strike a relatively hard object. The unit then, being so collapsible will not easily injure a person or damage the article struck and similarly will be easy to grab.

The diameter of the inflatable ring provides a sufficient grasping area for the user and the diameter of the entire unit allows for easy tossing and catching of the same.

It should be obvious that the applicant has provided a new and unique toy which through certain additive features increases the play value of the unit as compared to other similar toss toys currently available.

What I claim is:

1. A tossable toy disc including:

a. a generally arcuate, planar section;

b. a generally circular inflatable ring section secured to the outer edge of said planar section;

c. said planar section provided from a relatively soft, pliable material, rigidity afforded to said section by inflation of said ring section;

d. an articler receiving housing provided integrally with said planar section;

e. a chemiluminescent source of light receivable into said housing;

e. said ring providing at least a pair of pockets arranged to receive ball shaped elements therein;

f. strap means associated with each of said pockets to retain articles placed therein; and, g. ball shaped noise emitting means arranged in each of said pockets whereby the disc may be illuminated and be noise producing as the same is rotatably tossed through the air.

* * * * *